US011969044B2

(12) United States Patent
Lockett

(10) Patent No.: US 11,969,044 B2
(45) Date of Patent: Apr. 30, 2024

(54) RECONFIGURABLE HAT

(71) Applicant: Tamara Lee Lockett, Fort Worth, TX (US)

(72) Inventor: Tamara Lee Lockett, Fort Worth, TX (US)

(73) Assignee: Tamara Lee Lockett, Fort Worth, TX (US)

( * ) Notice: Subject to any disclaimer, the term of this patent is extended or adjusted under 35 U.S.C. 154(b) by 33 days.

(21) Appl. No.: 17/145,250

(22) Filed: Jan. 8, 2021

(65) Prior Publication Data

US 2022/0218063 A1 Jul. 14, 2022

(51) Int. Cl.
*A42B 1/206* (2021.01)
*D04C 1/06* (2006.01)

(52) U.S. Cl.
CPC ..... *A42B 1/206* (2013.01); *D04C 1/06* (2013.01); *D10B 2501/042* (2013.01)

(58) Field of Classification Search
CPC ..... A42B 1/206; A42B 1/006; A42B 1/019; A42B 1/04; A42B 1/201; D04C 1/06; D10B 2501/042
USPC ..... 2/171, 171.03, 195.8
See application file for complete search history.

(56) References Cited

U.S. PATENT DOCUMENTS 47,397 A * 4/1865 Coes ..... D5/7
137,032 A * 3/1873 Scharl ..... A42B 1/0186 2/172
4,937,885 A * 7/1990 Gregg ..... A42B 1/006 2/209.12
D375,188 S * 11/1996 Nickerson ..... D2/883
D381,791 S * 8/1997 Plummer ..... D2/875
6,026,514 A * 2/2000 Fricker ..... A42B 1/041 2/209.11
6,227,011 B1 * 5/2001 Cortinovis ..... A41D 20/00 66/8
2003/0106134 A1 * 6/2003 Kim ..... A42B 1/06 2/171
2003/0196851 A1 * 10/2003 Cowgill ..... G10K 11/28 181/178
2006/0191057 A1 * 8/2006 Lynn ..... A42B 1/225 2/171
2017/0042267 A1 * 2/2017 Guice ..... A42B 1/12

OTHER PUBLICATIONS

Byom: www.bing.com (see p. 10 of the Action for full citation), first available for viewing Mar. 22, 2019. (Year: 2019).*

* cited by examiner

*Primary Examiner* — William V Gilbert

(57) ABSTRACT

A wearable hat/head garment which can be made up of many braided facets of materials. The process of the flip action, braided materials are stitched together in a circular direction at or to the degrees of 0 to 90 degree angles. The 45-degree angle produces a roll motion, which allows the braids to change the position in which they are. To include the design has an opening at the top and bottom, which give an automatic versatility in styles once flipped upside down and inside out. These hats are created in array of colors and not limited to future colors, fabrics and trims. The hat/head garment collapses into a flat position for storage.

1 Claim, 19 Drawing Sheets

RECONFIGURABLE HAT

CROSS-REFERENCE TO RELATED APPLICATIONS

The present application claims priority to U.S. provisional patent application Ser. No. 17/145,250, filed on Jan. 8, 2021. The entire disclosure is included herein in its entirety at least by reference.

BACKGROUND OF THE INVENTION

1. Field of the Invention

The present invention is in the field of hat-making and the origin of milliner; fashion head garments particularly to methods of wearing a stylish designer hat which flips in several styles uniquely created with various braided materials.

2. Discussion of the State of the Art

In the field of fashion, accessories and articles of apparels. Hats of any various styles in reference to head covering may serve prevalent functions, religious but often signify the wearer's sensibility to fashion symbolizing the office or rank of the individual.

One of the first pictorial depictions of a hat appears in a tomb in Thebes showing people wearing cone-like straw hats dating back to 3,200 BC. History 27,000 to 30,000 BC., Vensus of Willendorf figurine may depict a woman wearing a woven hat. Hat and headpieces have provided multiple uses from acting as a basket for cropping, shade from the heat, protection from the rain in addition to expressing creativity, attracting attention, and showing status levels.

The scriptural basis for the tradition resides in I Corinthians 11:1-6, On Covering the Head in Worship Follow my example, as I follow the example of Christ.

I praise you for remembering me in everything and for holding to the traditions just as I passed them on to you. But I want you to realize that the head of every man is Christ, and the head of the woman is man, and the head of Christ is God. Every man who prays or prophesies with his head covered dishonors his head. But every woman who prays or prophesies with her head uncovered dishonors her head—it is the same as having her head shaved. For if a woman does not cover her head, she might as well have her hair cut off; but if it is a disgrace for a woman to have her hair cut off or her head shaved, then she should cover her head.

In contrast fashion follows function, hats are wearable art developing more attention over decades. Hat makers are steady creating tailor-made hats for their clients while in turn mass manufacturing producing increased numbers of hat wearer's. It's a tradition that dates back to when the Kentucky Derby first started in 1875; Royal protocol says, "that women must wear hats to all formal royal occasions," an etiquette rule which dates back to the 1950's. It's also improper for upper class royal women to show their hair in public. Times have definitely changed . . . Wearing hats to worship is a traditional in African Culture. Many of the hats are designed after west Africa hair dressing, filled with braids and beads. After slavery as the black middle class began to emerge, the hat symbolized status and God's blessings in the woman's life. Combining glamour and holiness, Sunday hats are colorful, flamboyant, enormous, and stylish; some made of straws, felts, furs, fabrics, rhinestones and other braided materials. In addition to instilling pride and confidence, the hats remind the wearers to carry themselves like queens. Culturally, church hats became a strong symbol of the ability to triumph over hardship.

Therefore, Bridging the gap of hat wearer's from generation to generation. Carving out a niche that gives the artistry and creativity to a head garments which an individual wears. There are several items known in the prior art of hats to head garments worn to be stylish or with a purpose.

SUMMARY OF THE INVENTION

As stated above the invention provides a fashion wearable head garment which can be made up of many facets of braided materials. An embodiment of present invention provides the changing style apparatus, including:

The process of the flip action, braided materials are stitched together in a circular direction at or to the degrees of 0 to 90 degree angles. The 45-degree angle produces a roll motion, which allows the braids to change the position in which they are. The different arrangement of styles also includes the size of the hat due to the length and width of the braids and embellished materials. The length of the braids and/or the embellishment of materials and fabrics chosen will cause various effects of movement. The width of the braid also contributes to the change of positioning the desired style; the length for example, but not subjected to a 84 inch braid which is sewn and/or embroidered together in a circular pattern at a 45 degree angle will produce movement but compared to 164 inch=13.67 feet braid will achieve different variation of movement. The braids can be created with but not limited to synthetic fibers, cotton, cellulosic fibres (wood based)/viscose, wool, silk, leather, bast fibers (plant based), experimental fabrics, recycled fabric and/or materials, sustainable fabrics and hair fibers (synthetic or natural). The embellished materials includes but not limited to fabric trims, gold and silver, diamonds and/or rhinestones, lace, other decorative ornaments. To include the design has an opening at the top and bottom, which give an automatic change styles of wearing once its flipped upside down and inside out. These hats are created in array of colors and not limited to future colors. Smart textile fabric can be made from materials ranging from traditional cotton, polyester and nylon, to advanced fabrics with integrated functionalities. A Harlem milliner sums it up perfectly; "Buy the hat first, and the outfit to go with it is merely an accessory."

BRIEF DESCRIPTION OF THE DRAWING FIGURES

FIGS. 1A-1F are elevations of each element that enhances the movement and structure of the hat; according to an embodiment of the present invention. Braided materials and its ability to change styles by movement.

FIG. 1A an elevation view of two braided strands parallel to one another; the braided material are from synthetic hair fibers. The two individual braids illustrates how the braided materials are comprised FIG. 1B an elevation side view of organized layers of braided materials sewn/stitched together in a circular pattern with invisible and/or visible threading FIG. 1C an elevation top view showing the opening at the base that sits on the crown of head; braids upright position top of the hat/head garment to be altered by changing positions of braided materials FIG. 1D a front elevation view of braided materials sewn together illustrate a crown styled look "smaller opening" sits on the base crown of head with the wider opening of braided materials in a upright position FIG. 1E a front elevation view of braided materials sewn together illustrate a fisherman styled look "smaller opening" the base sitting on the crown of head with then the wider opening of braided materials in a downward position FIG. 1F an elevation and top view showing the opening at the base sitting on the crown of head; braids downward position hat/head garment to be altered by changing positions of braided materials FIGS. 2A-2H are elevation views of a braided recycle blue jean fabric and braided synthetic hair fibers styled hat/head garment. The sample drawings will illustrate the various styles formed by simple movement FIG. 2A a front elevation view of braided recycled blue jean fabric and synthetic hair fibers the Angled Crown Style FIG. 2B a front elevation view of braided recycled blue jean fabric and synthetic hair fibers the Queen Style FIG. 2C a front elevation view of braided recycled blue jean fabric and synthetic hair fibers the Windsor Style FIG. 2D is a front elevation view of braided recycled blue jean fabric and synthetic hair fibers the Bonnet Style FIG. 2E is a front elevation view of braided recycled blue jean fabric and synthetic hair fibers the CowGirl Style FIG. 2F is a side view elevation view of braided recycled blue jean fabric and synthetic hair fibers the CowGirl Style FIG. 2G is a back elevation view of braided recycled blue jean fabric and synthetic hair fibers the CowGirl Style FIG. 2H is a front elevation view of braided recycled blue jean fabric and synthetic hair fibers the Flipped Up Style FIGS. 3A-3B are elevation views of braided recycled blue jean fabric and synthetic hair fibers comprise color variations of denim and braided synthetic hair fibers. Illustrates the base sitting on crown of head at a degree angle braided materials upward position FIG. 3A is a front elevation view of 3 braided recycled blue jean fabric and synthetic hair fibers in the Crown Style FIG. 3B is a side elevation view of 3 braided recycled blue jean fabric and synthetic hair fibers in the Crown Style FIGS. 4A-4B are elevation views of 3 hats, braided materials presented is synthetic hair fibers showing versatility in designer styles 4A and 4B.

FIG. 4A is an elevation views of 3 hats, braided materials presented is synthetic hair fibers showing versatility in designer styles FIG. 4B is an elevation views of 3 hats, braided materials presented is synthetic hair fibers showing versatility in designer styles FIGS. 5A-5D are elevation views of a custom made hat; braided with synthetic hair fibers embellished with glittered yarn materials FIG. 5A elevation of a custom braid hat; braided with synthetic hair fibers in the Crown Style FIG. 5B a side view elevation of a custom braid hat; braided with synthetic hair fibers a "tilt back" Style FIG. 5C a side view elevation of a custom braid hat; braided with synthetic hair fibers a Side Flipped Style FIG. 5D a side view elevation of a custom braid hat; braided with synthetic hair fibers a Flipped Style FIGS. 6A-6D are elevation views of a custom made hat; braided with recycled blue jean fabric FIG. 6A elevations of a custom made hat; braided with recycled blue jean fabric Crown Style FIG. 6B elevations of a custom made hat; braided with recycled blue jean fabric Fisherman style FIG. 6C elevations of a custom made hat; braided with recycled blue jean fabric side flip look FIG. 6D elevations of a custom made hat; braided with recycled blue jean fabric Cowgirl Style FIGS. 7A-7D are elevations views of a custom made hat; braided with fur yarn, synthetic hair fibers FIG. 7A elevations views of a custom made hat; braided with fur yarn, synthetic hair fibers Crown Style look FIG. 7B elevations views of a custom made hat; braided with fur yarn, synthetic hair fibers Fisherman Style look FIG. 7C elevations views of a custom made hat; braided with fur yarn, synthetic hair fibers Side Flip look FIG. 7D elevations views of a custom made hat; braided with fur yarn, synthetic hair fibers CowGirl Style Look FIGS. 8A-8D are elevation views of a custom made hat; braided with yarn and synthetic hair fibers flipped in various styles but not limited to these particular styles FIG. 8A is an elevation sideview of a custom made hat; braided with yarn and synthetic hair fibers FIG. 8B is an elevation back view of a custom made hat; braided with yarn and synthetic hair fibers FIG. 8C is an elevation view of a custom made hat; braided with yarn and synthetic hair fibers FIG. 8D is an elevation view of a custom made hat; braided with yarn and synthetic hair fibers Crown Style FIGS. 9A-9E are elevations of a custom made hat; braided with fur yarn, synthetic hair fibers and embellished with a bling trim one hat flipped in several style but not limited to these styles FIG. 9A elevation of a custom made hat; braided with fur yarn, synthetic hair fibers and flipped in the Queen style braided with fur yarn and synthetic hair fibers; exposed look FIG. 9B elevation of a custom made hat; braided with fur yarn, synthetic hair fibers and flipped in the Fisherman style braided with fur yarn and synthetic hair fibers; exposed look FIG. 9C elevation of a custom made hat; braided with fur yarn, synthetic hair fibers and flipped in the Queen style braided with fur yarn and synthetic hair fibers; exposed look FIG. 9D elevation of a custom made hat; braided with yarn and synthetic hair fibers in Bonnet Style FIG. 9E elevation of a custom made hat; braided with fur yarn, synthetic hair fibers and flipped in the Stylish look braided with fur yarn and synthetic hair fibers; exposed look FIGS. 10A-10T are elevations of a custom made hat; braided with fur yarn, synthetic hair fibers and trim (a basketball image) flipped several styles just by adjusting or moving the braids with a bending motion but not limited to these particular styles FIG. 10A elevation of a custom made hat; braided with fur yarn, synthetic hair fibers and trim (a basketball image) in the Crown Style FIG. 10B elevations of a custom made hat; braided with fur yarn, synthetic hair fibers and trim (a basketball image) in the Flipped Queen Style FIG. 10C elevation of a custom made hat; braided with fur yarn, synthetic hair fibers and trim (a basketball image) in the flared out angled brim style FIG. 10D elevation of a custom made hat; braided with fur yarn, synthetic hair fibers and trim (a basketball image) in the flared out brim style look FIG. 10E elevation of a custom made hat; braided with fur yarn, synthetic hair fibers and trim (a basketball image) in the One-sided Flipped Style FIG. 10F elevation of a custom made hat; braided with fur yarn, synthetic hair fibers and trim (a basketball image) in the One-sided Flipped Style FIG. 10G elevation of a custom made hat; braided with fur yarn, synthetic hair fibers and trim (a basketball image) in the CowGirl Style FIG. 10H elevation of a custom made hat; braided with fur yarn, synthetic hair fibers and trim (a basketball image) in the CowGirl Style FIG. 10I sideview elevation of a custom made hat; braided with fur yarn, synthetic hair fibers and trim (a basketball image) in the flared out brim style FIG. 10J elevation of a custom made hat; braided with fur yarn, synthetic hair fibers and trim (a basketball image) in the Crown Style FIG. 10K elevation of a custom made hat; braided with fur yarn, synthetic hair fibers and trim (a basketball image) in the flared out brim style FIG. 10L sideview elevation of a custom made hat; braided with fur yarn, synthetic hair fibers and trim (a basketball image) in the Flipped Style look FIG. 10M elevation of a custom made hat; braided with fur yarn, synthetic hair fibers and trim (a basketball image) in the Bonnet Style look FIG. 10N elevation of a custom made hat; braided with fur yarn, synthetic hair fibers and trim (a basketball image) in the Flipped Style look FIG. 10O elevation of a custom made hat; braided with fur yarn, synthetic hair fibers and trim (a basketball image) in the Fisherman Style look FIG. 10P elevation of a custom made hat; braided with fur yarn, synthetic hair fibers and trim (a basketball image) in the Fisherman Style look FIG. 10Q sideview elevation of a custom made hat; braided with fur yarn, synthetic hair fibers and trim (a basketball image) in the Flipped Style look FIG. 10R back view elevation of a custom made hat; braided with fur yarn, synthetic hair fibers and trim (a basketball image) in the Crown Style FIG. 10S back view elevation of a custom made hat; braided with fur yarn, synthetic hair fibers and trim (a basketball image) in the Queen Style FIG. 10T back view elevation of a custom made hat; braided with fur yarn, synthetic hair fibers and trim (a basketball image) in the flared out brim style look FIG. 11 is a top view elevation of the open top circular braid pattern; braided with synthetic hair fibers alternated with embellished trim style FIG. 12 is a top view elevation of the open top circular braid pattern; braided with synthetic hair fibers the crown of head with hair exposed FIG. 13 elevation views of the Crown Styled Hat; braided with synthetic hair fibers and recycled jeans showing versatility in designer styles in fashion

DETAILED DESCRIPTION OF FIGURES

The inventor provides a unique hat/head garment which flips in several styles, made with various braided materials, fabrics and trims. The present invention is described in enabling detail in the following examples, which may represent more than one embodiment of the present invention.

FIGS. 1A-1F are elevation views of each element that enhances the movement and structure of the hat; the embodied braided materials and its function to change styles by movement. 100 show individual braids parallel to one another sewn together to create a desired style 103 starting with the base wrapping the braid in a circular pattern 101 stitching braids together in a degree angle upwards 102 until you get to the top of your 104 desired look. The double open ends 102/103 and 107/108 when flipped from 104 to 105 the style changes instantly when the sewn together braided material 106 are reversed.

FIGS. 2A-2H are elevation views of braided recycled blue jean fabric and synthetic hair fibers flipped in several styles by simple movement and change pattern in the braided materials. First braid at the base smaller end of the hat/head garment implemented with recycled blue jean material 200 is continuous braid to 201 looping around in circular direction; alternated with braided synthetic hair fibers 202 continuous braid 203 are sewn together. In the circular direction of the braided blue jean materials the continuous braid of 201 to 204; alternating with the synthetic hair fibers 205 to 206. The continuous looping around in circular direction; braided blue jean materials 207 to 208 stitched together alternating the synthetic hair fibers braid 209 to 210 which 209 is the exposed end braid of the synthetic hair fibers at the larger opening on one side of the 104 in this view. The continuous looping around in circular direction of the braided recycled blue jean materials 204 to 211 to 212 which is stitched together alternated by the braided synthetic hair fibers. The continuous looping around in circular direction of the braided synthetic hair fibers 206 to 210 to 213 which 213 is the exposed end braid of the synthetic hair fibers at the larger opening on one side of the 104 in this view Angled Crown Style. The end braids of the braided materials sewn in a stylish fashion 210 stitched to 204 to give a custom and unique look. As 206 and 210 gives an illusion as a design. 214 is a changed position of hat/head garment placed on crown of head creating Queen Style. 215 is a changed position of hat/head garment placed on crown of head creating Windsor Style. 216 is a changed position of hat/head garment placed on crown of head creating Bonnet Style. 217 is a changed position of hat/head garment placed on crown of head creating CowGirl Style with a side tilt. 218 is a side view of hat/head garment placed on crown of head creating CowGirl Style. 219 is a back view of hat/head garment placed on crown of head creating CowGirl Style showing the end of the braided recycled blue jean 212. 220 is a changed position of hat/head garment placed on crown of head creating Flipped Up Style.

FIGS. 3A-3B are elevations of a custom made hat; braided with various recycled blue jean fabric and synthetic hair fibers Crown Style also illustrates the base sitting on the crown of head and wider opening is upright. The manipulation of the ending of the braided materials stitched together gives a designer styled look 300 and 302. 301 gives more of a clean look exposure; alternating braided materials without displaying the twisting illusion of braids. 303, 304 and 305 are side views which illustrates the base sitting on the crown of head and wider opening is upright. The manipulation of the ending of the braided materials stitched together gives a designer styled look on 303 and 305. 304 is sitting upright exposing alternating braided materials without displaying the twisting illusion of braids.

FIGS. 4A-4B are elevations of a custom braid hat; braided with synthetic hair fibers only also showcasing versatility with movement and changing position of the hat/head garments gives a different style with the rolling effect. 400 is the cowgirl style whereas the rolling of the stitched braids gives the illusion with sides flipped up as a brim. 401 sitting on the crown of the head in an upright position one side flipped as 402 is a high crowned style. 403 and 404 are views of a side brim look the base sitting on the crown of the head displaying a front view 404 and 403 a side view. 405 gives the illusion of a flipped up brim in the back and sides with a visor in the front of the head.

FIGS. 5A-5D are elevations of a custom braid hat; braided with synthetic hair fibers and embellished with glittered yarn. 501 Crown Style, 501 braids going in a circular pattern in an upright position. 502 a side view elevation with a change in position exposing the crown of head, 502 the illusion of a brim laying on the top of the head and the back of head exposed. 503 and 504 side view changed position with movement of braids. 503 has a twist in the front and back as flipped on one-side giving this unique style. 504 sits on the forehead the changed position of braided materials gives this an brim style look sitting around the perimeter of the head.

FIGS. 9A-9E are elevations of a custom made hat; braided with yarn and synthetic hair fibers in several styles which includes 901 and 903 the Crown Style the smaller opening on crown of head with larger opening upright. 902 and 904 the smaller opening on crown of head with larger openings facing downward giving the illusion of a Fisherman Hat. 902 and 904 to include bonnet style with slight movement changes the style desired. 905 a freestyle flipped stylish produces this custom look.

Figure 1A:
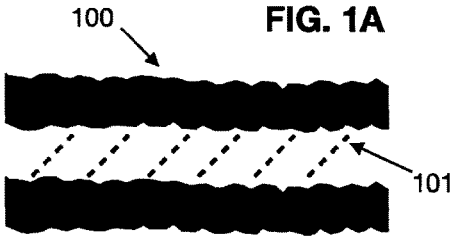
Figure 1B:
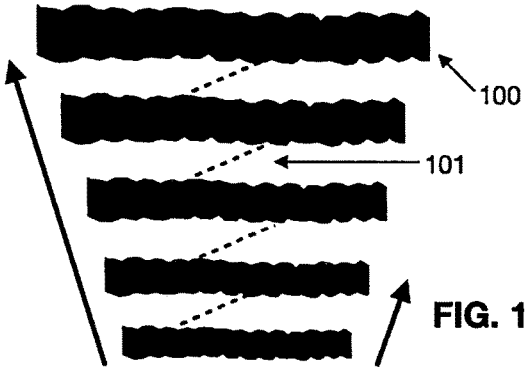
Figure 1C:
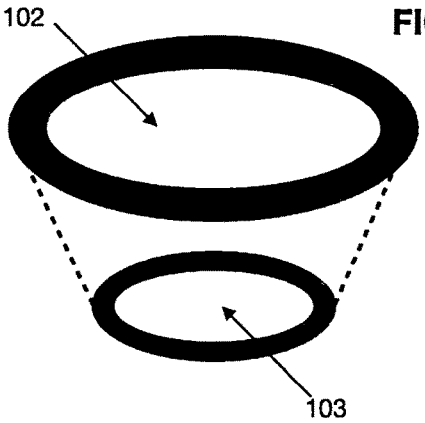
Figure 1D:
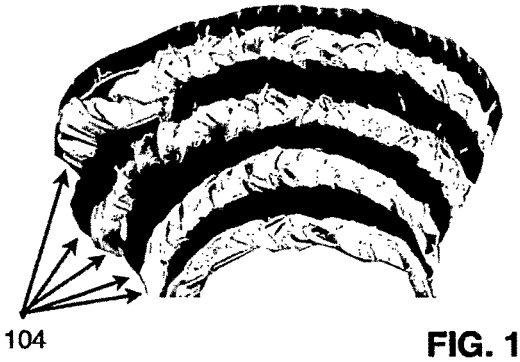
Figure 1E:
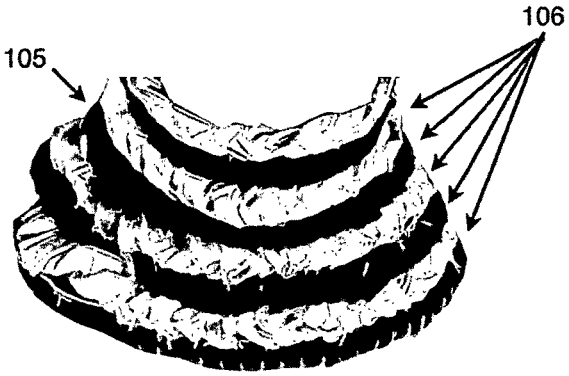
Figure 1F:
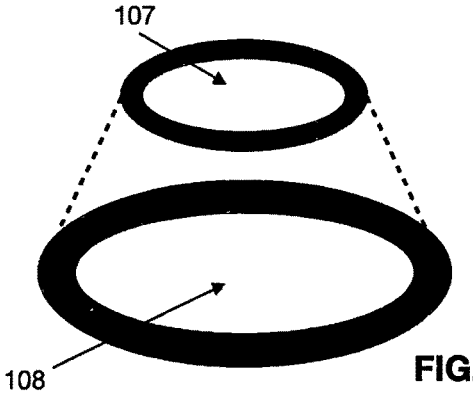
Figure 2A:
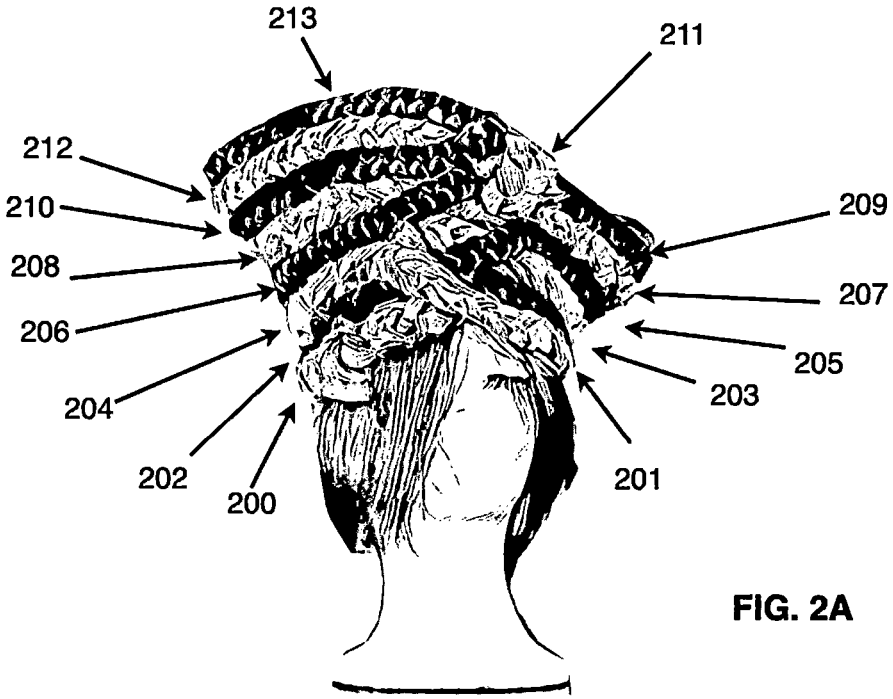
Figure 2B:
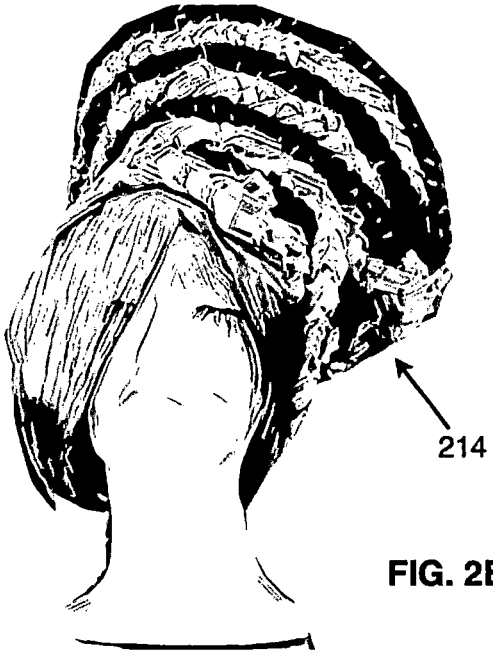
Figure 2C:
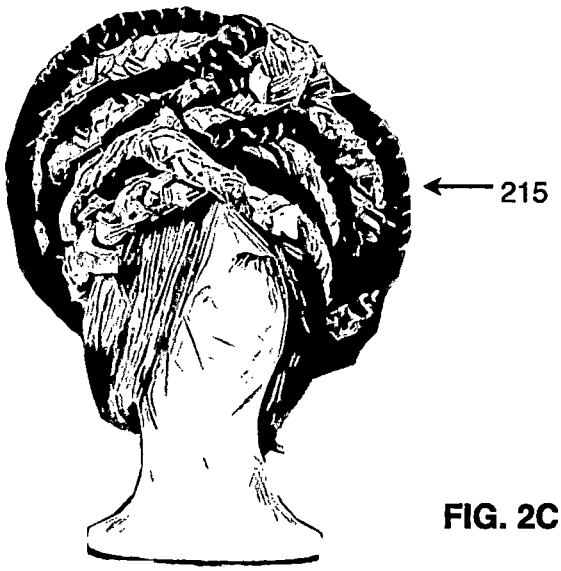
Figure 2D:
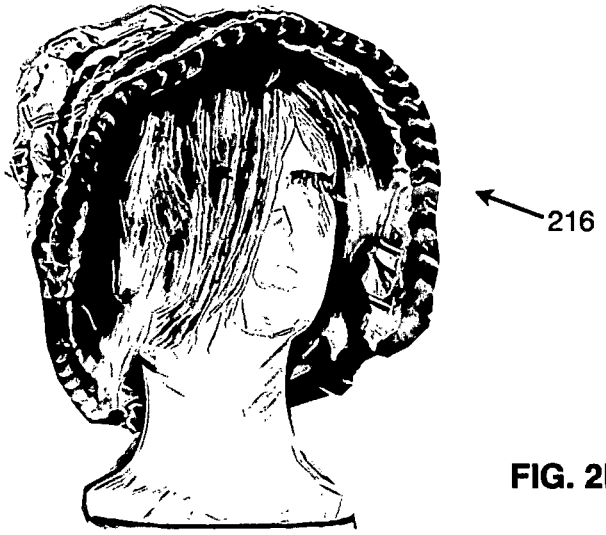
Figure 2E:
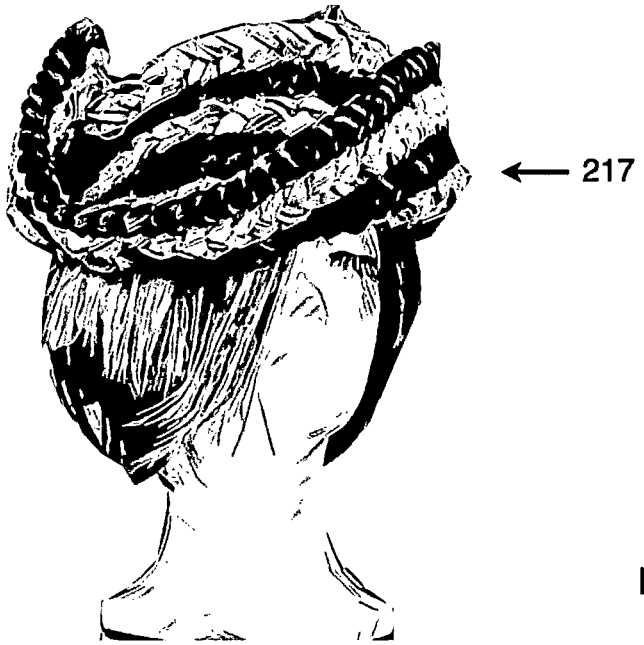
Figure 2F:
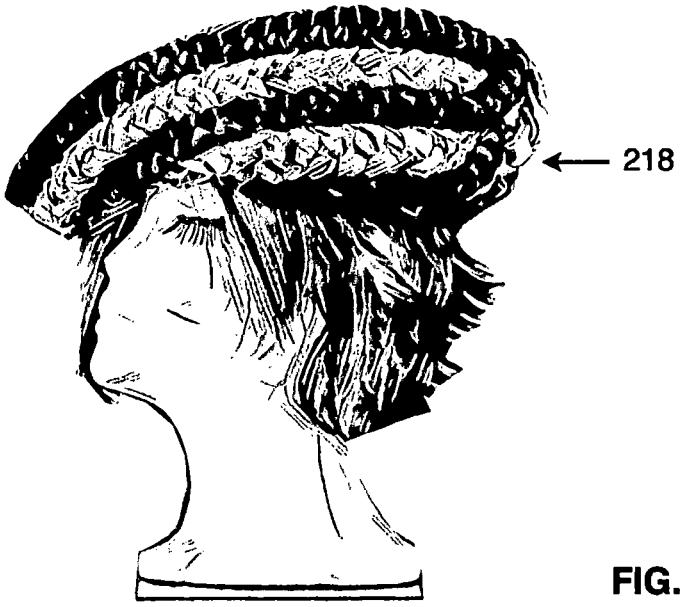
Figure 2G:
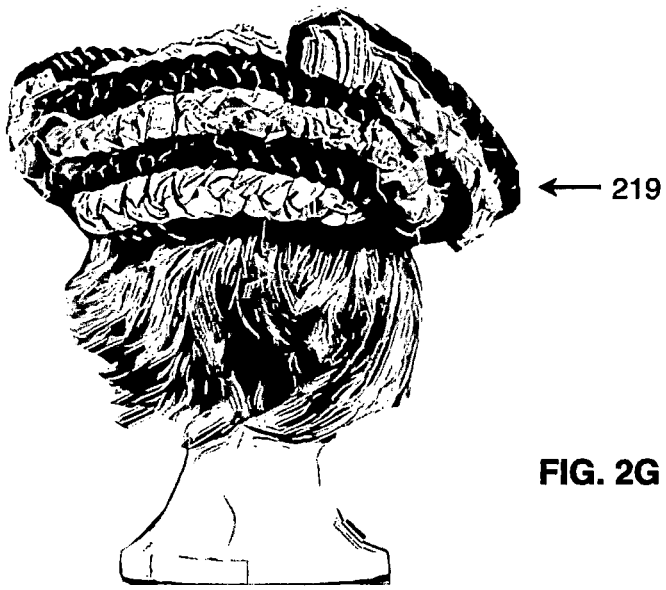
Figure 2H:
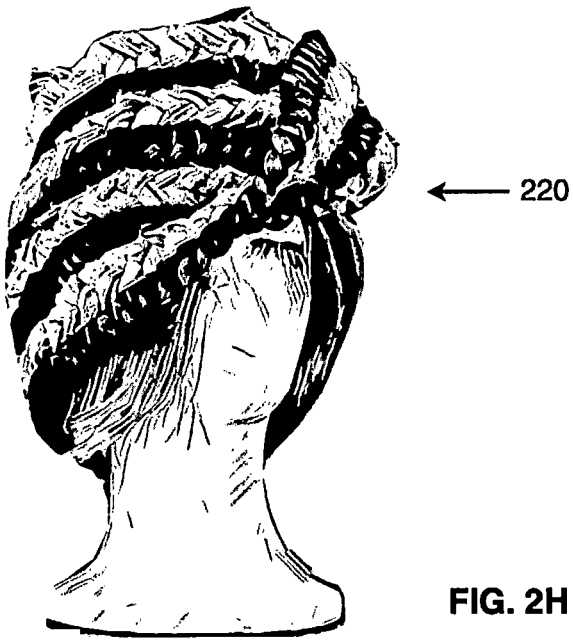
Figure 3A:
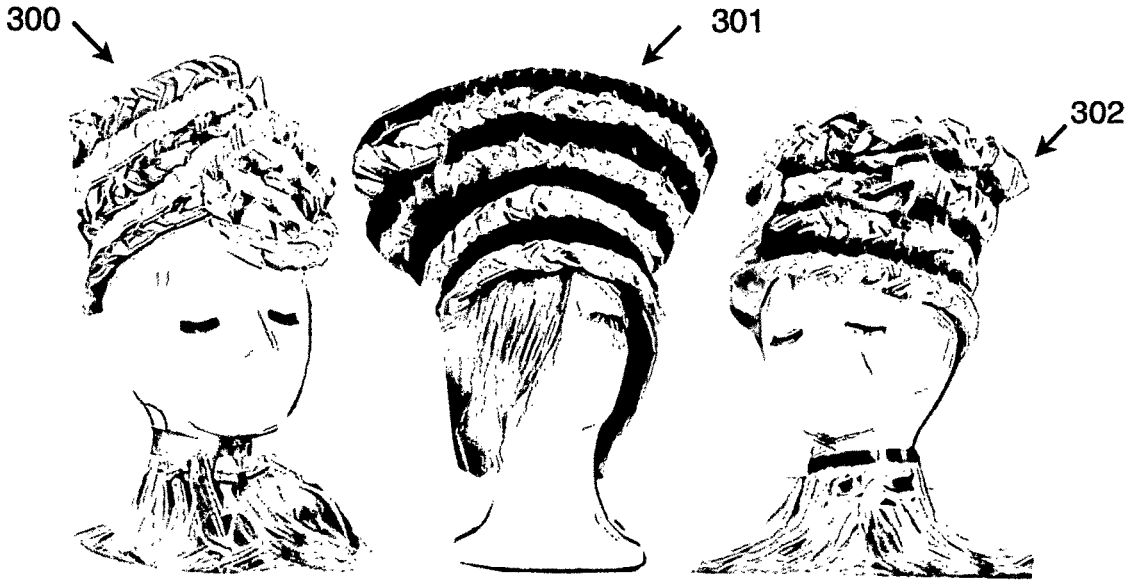
Figure 3B:
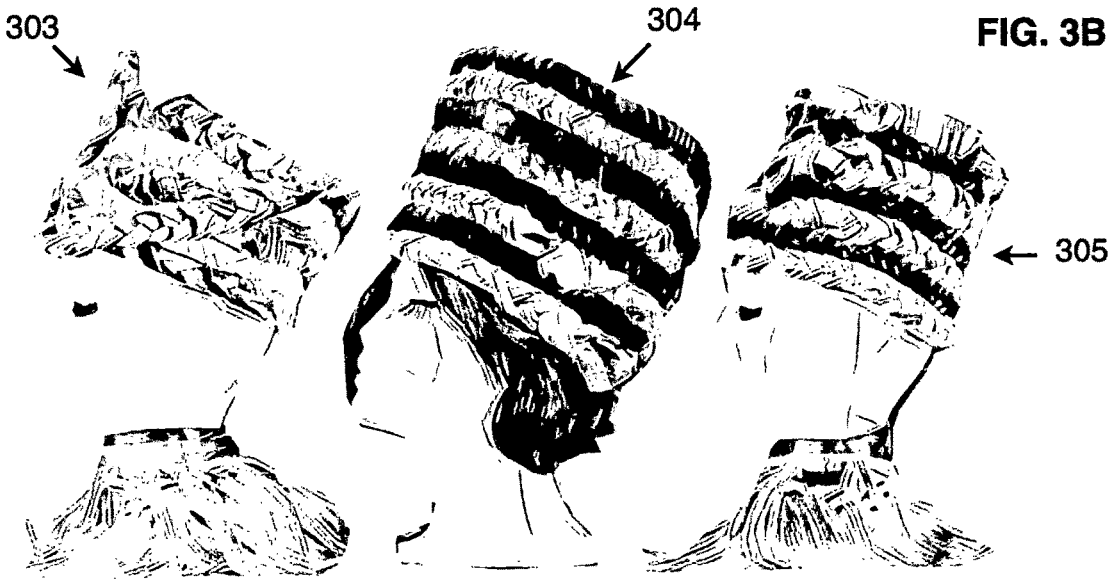
Figure 4A:
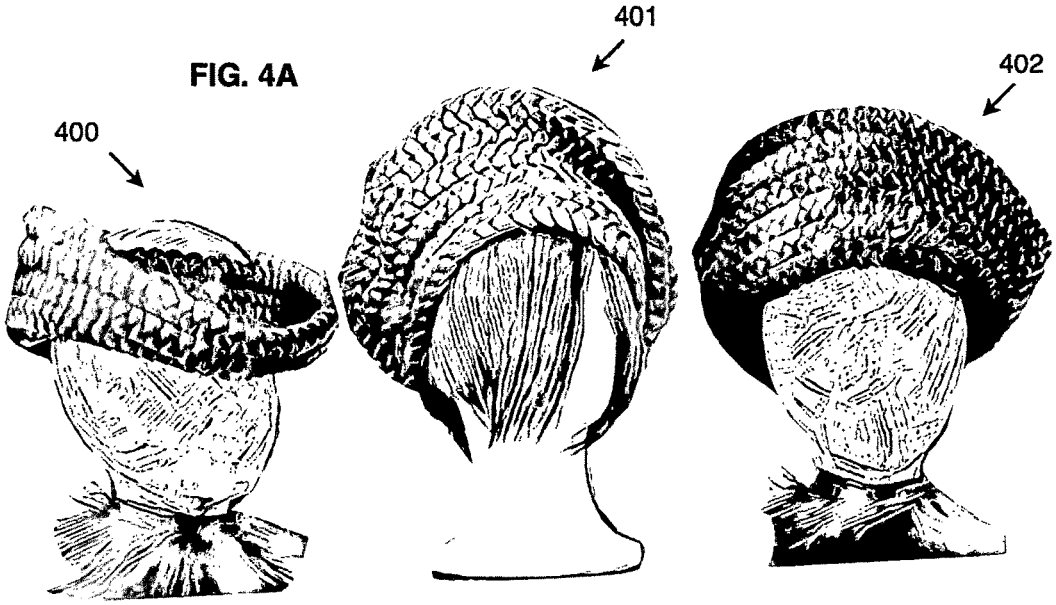
Figure 4B:
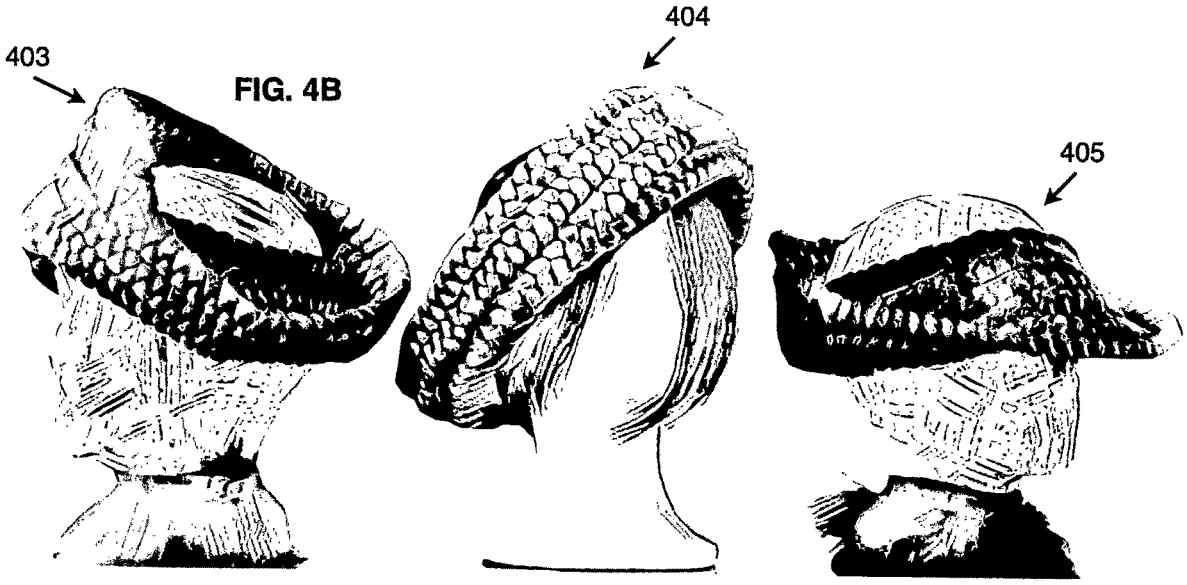
Figure 5A:
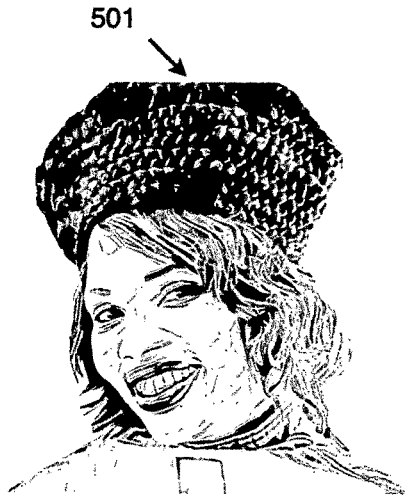
Figure 5B:
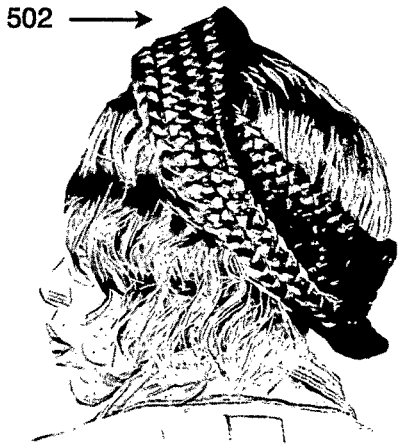
Figure 5C:
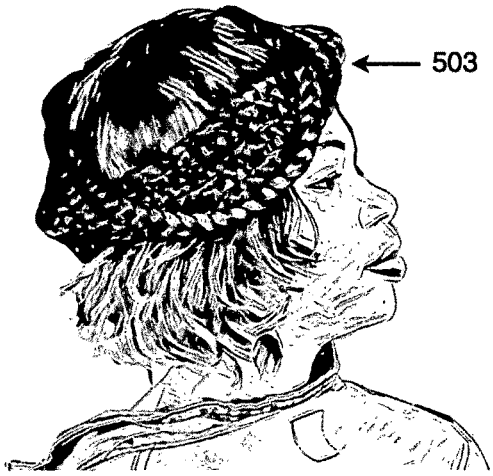
Figure 5D:
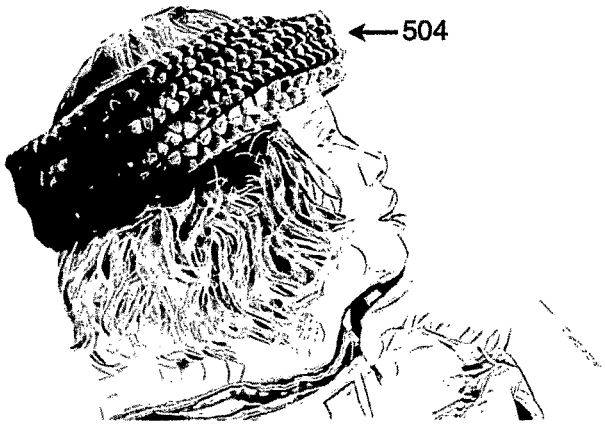
Figure 6A:
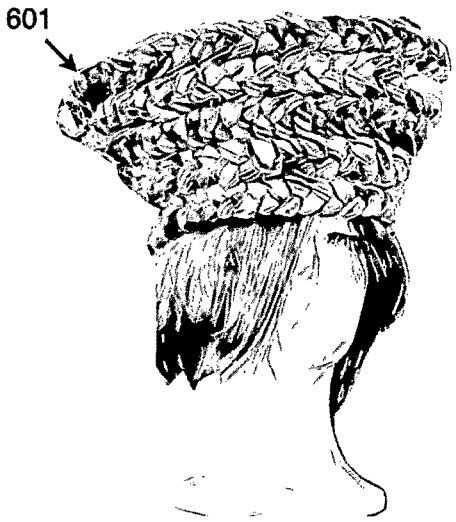
FIGS. 6A-6D are elevations of a custom braided hat styles; braided with recycled blue jean materials. 601 relates to 301 Crown Style. 602 related to FIG. 1F Fisherman Style 601 displays the brim in a downward position. 603 relates to 217 CowGirl Style with a side tilt/flip. 604 is a CowGirl Style simple movement changes desired look.
Figure 6B:
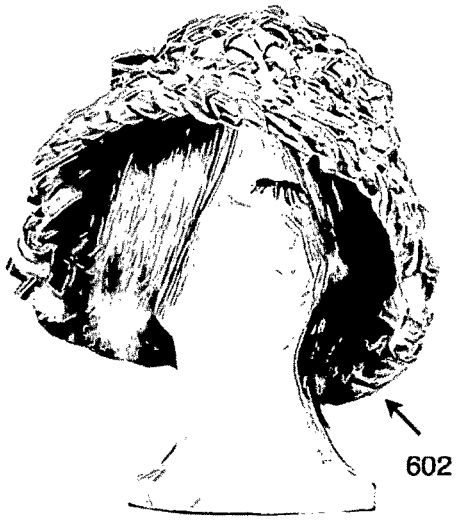
Figure 6C:
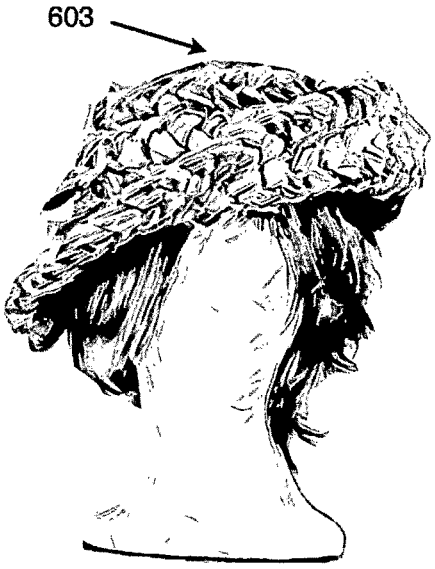
Figure 6D:
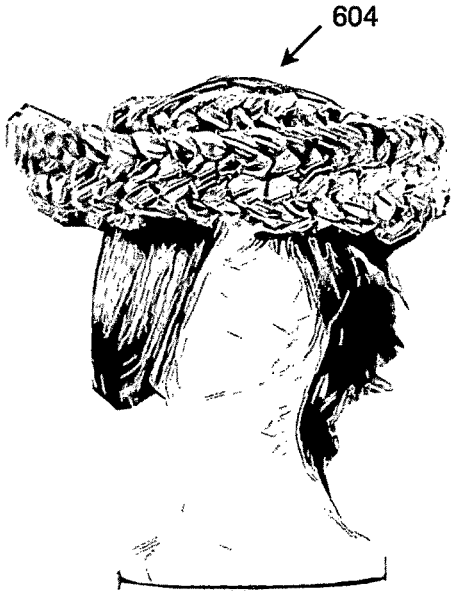
Figure 7A:
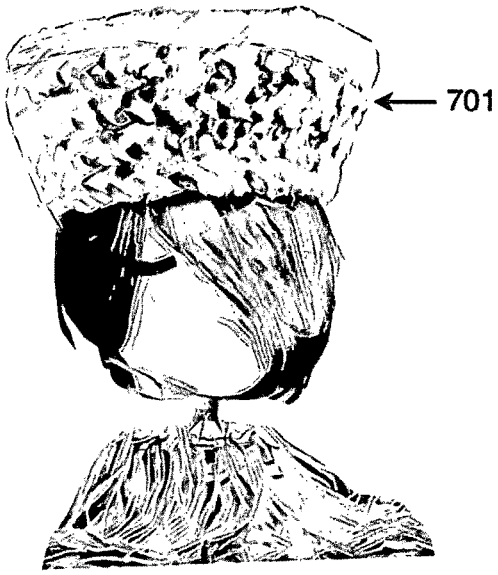
FIGS. 7A-7D are elevations of a custom made hat; braided with synthetic hair fibers and fur yarn. 701 relates to 301 Crown Style. 702 relates to FIG. 1F Fisherman Style. 703 illustrates with simple movement from 701 produces a different look one side pulled down with crown of head exposed. 704 relates to 604 CowGirl Style.
Figure 7B:
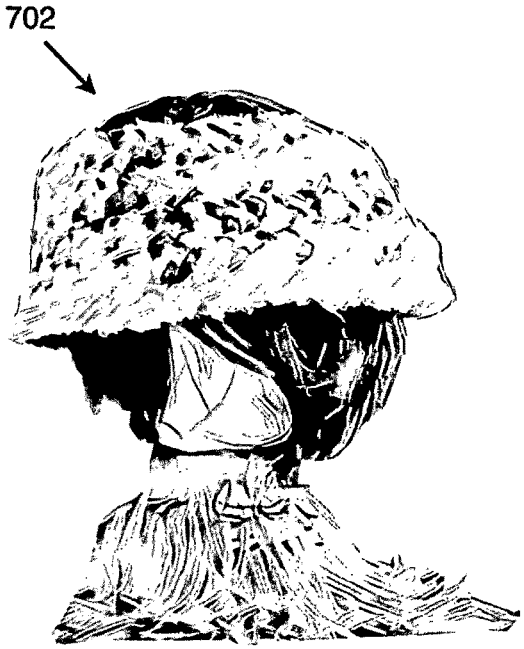
Figure 7C:
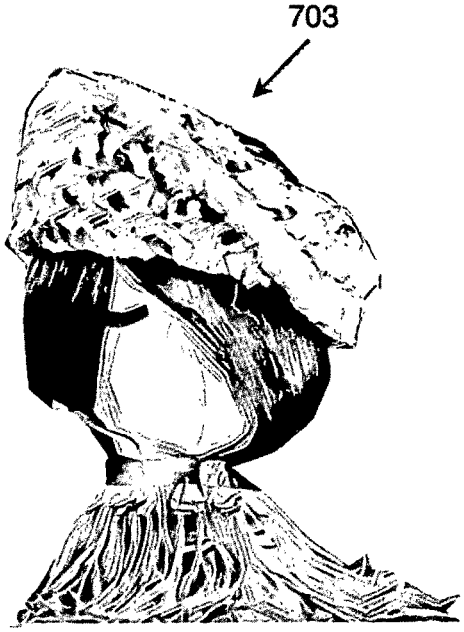
Figure 7D:
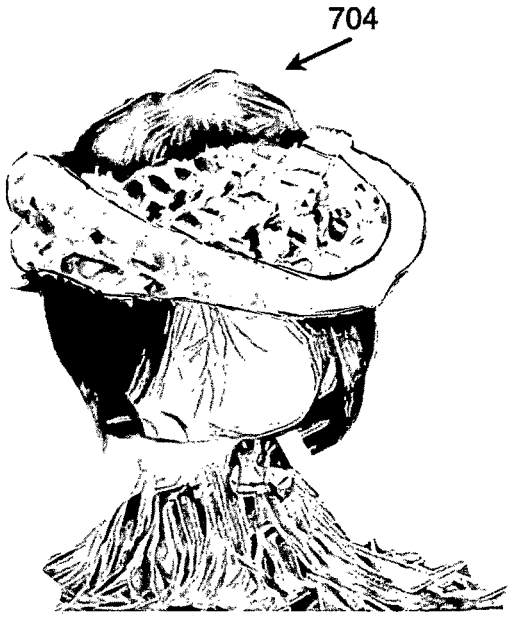
Figure 8A:
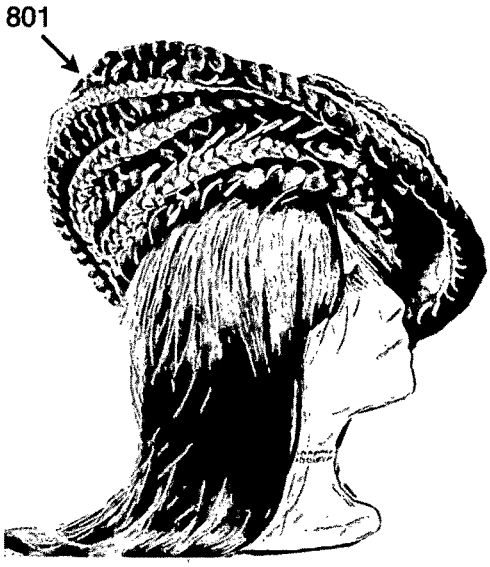
FIGS. 8A-8D are elevations of a custom made hat; braided with synthetic hair fibers and yarn in several styles. 801 illustrates a diverse look by simply changing position of the hat/head garment. 802 shows the back view; 801 with the crown of head exposed also give freedom to any hairstyle to move freely. 803 relates to 802 tilt with opening at top of head. 804 relates to FIG. 2A the Crown Style.
Figure 8B:
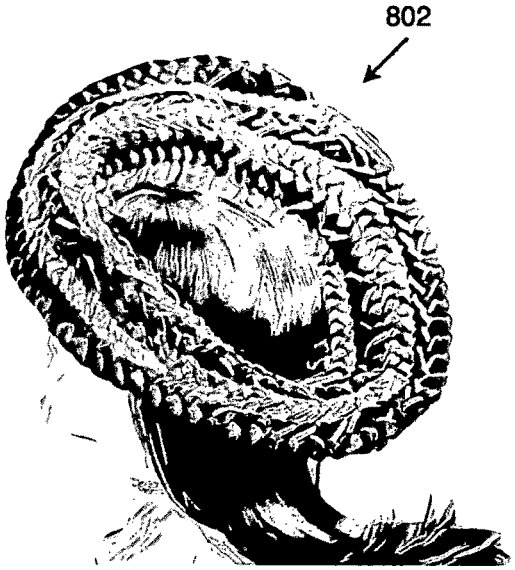
Figure 8C:
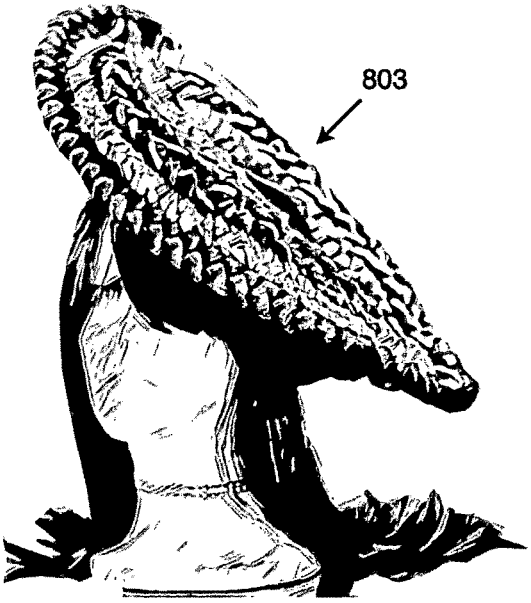
Figure 8D:
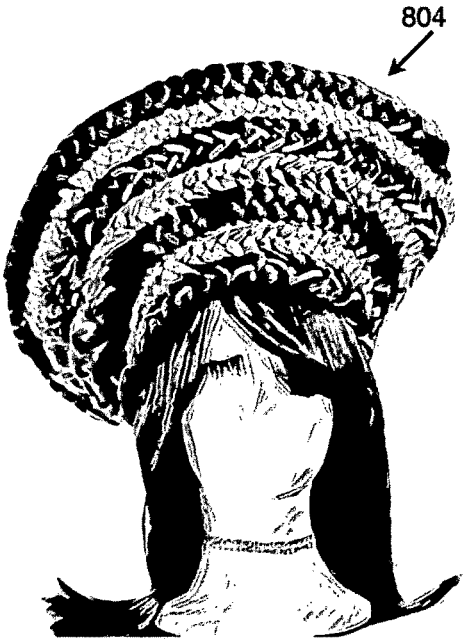
Figure 9A:
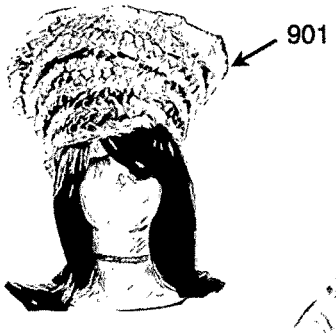
Figure 9B:
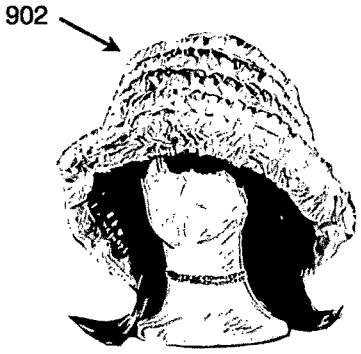
Figure 9E:
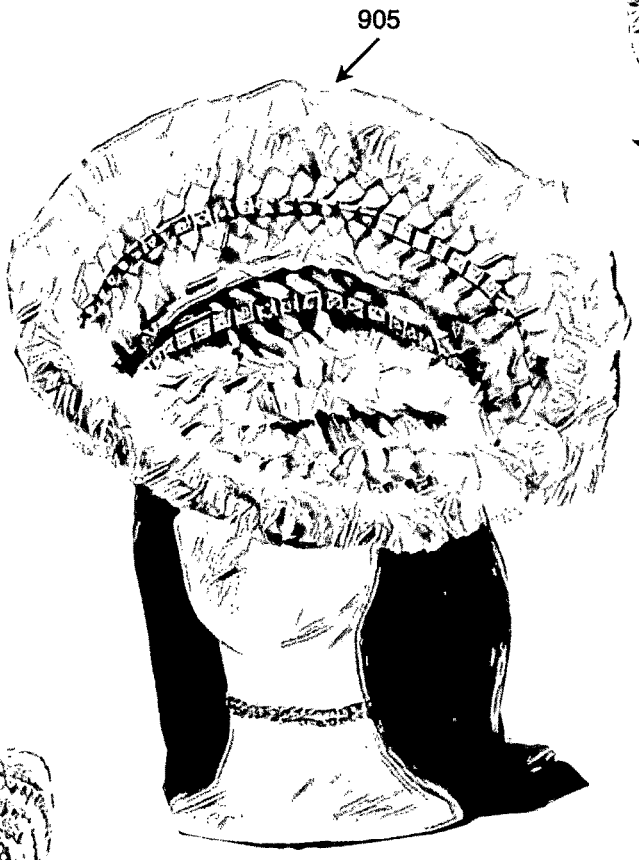
Figure 9C:
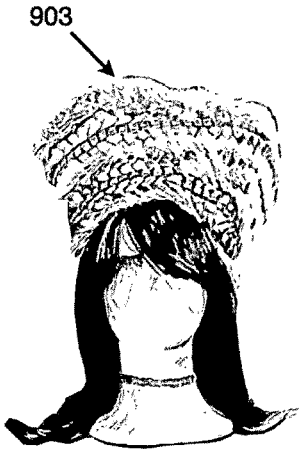
Figure 9D:
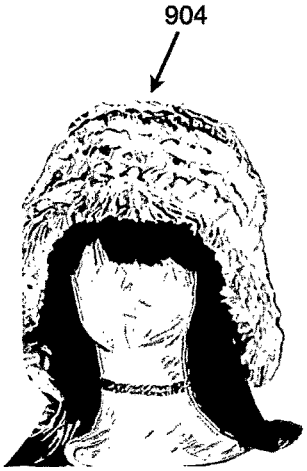
Figure 10A:
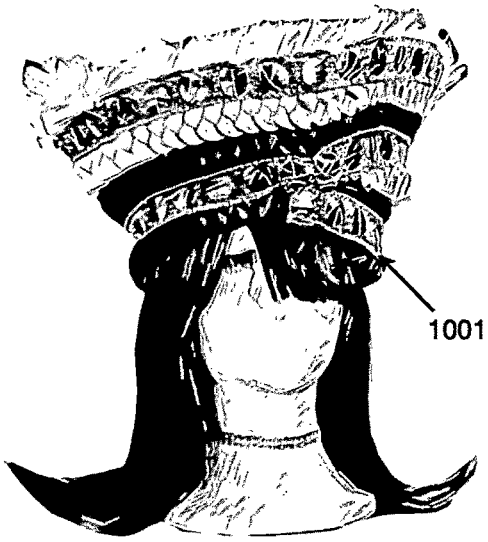
Figure 10B:
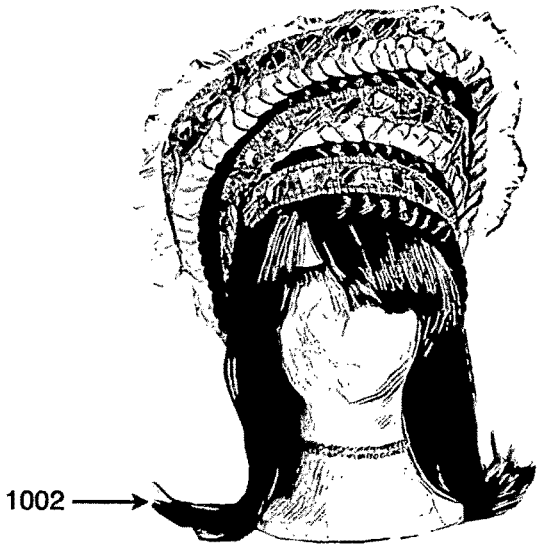
Figure 10C:
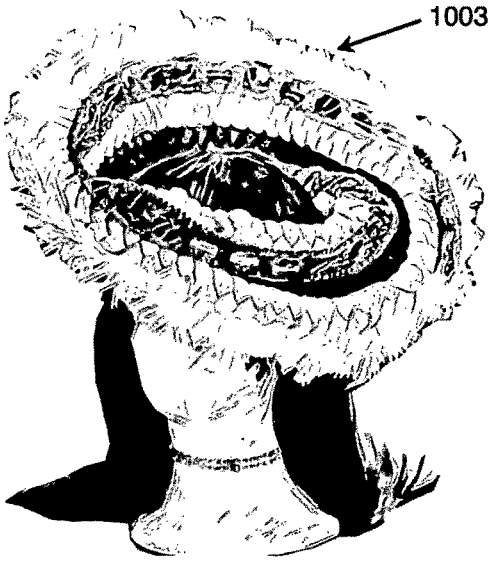
Figure 10D:
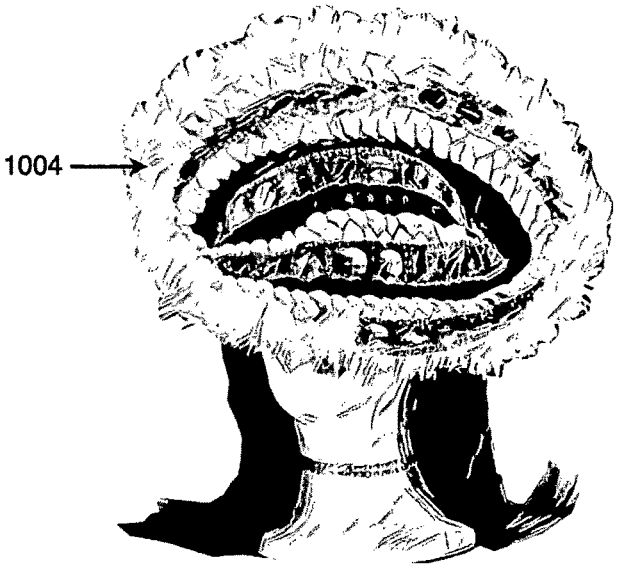
Figure 10E:
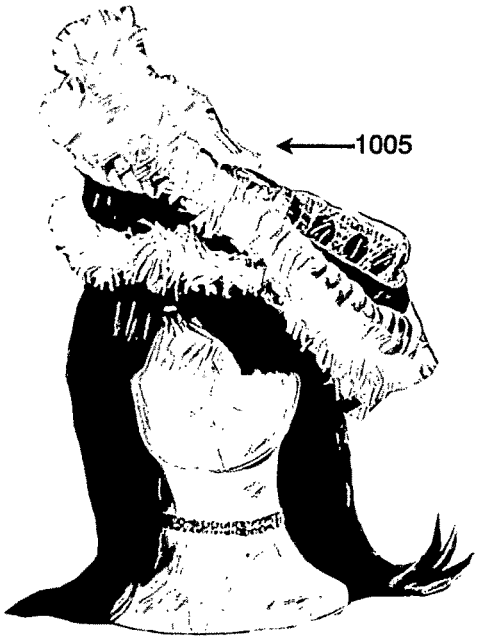
Figure 10F:
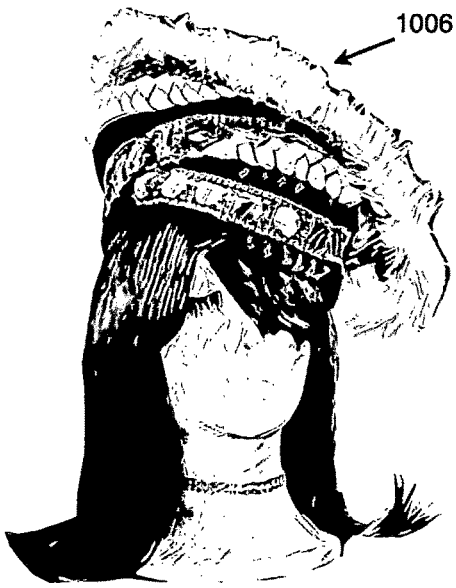
Figure 10G:
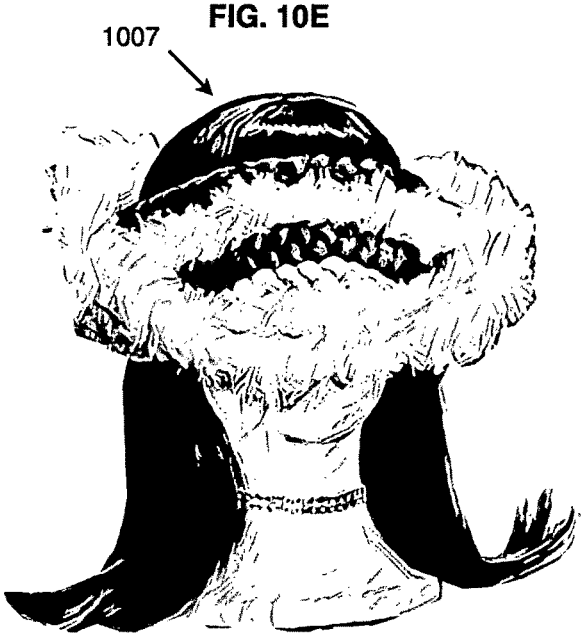
Figure 10H:
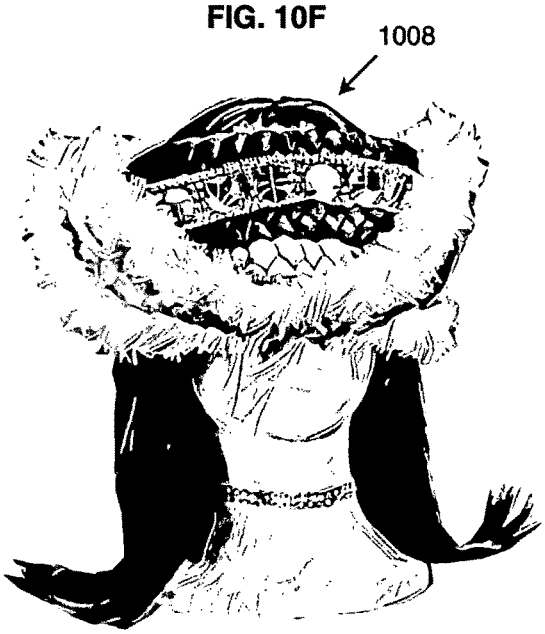
Figure 10I:
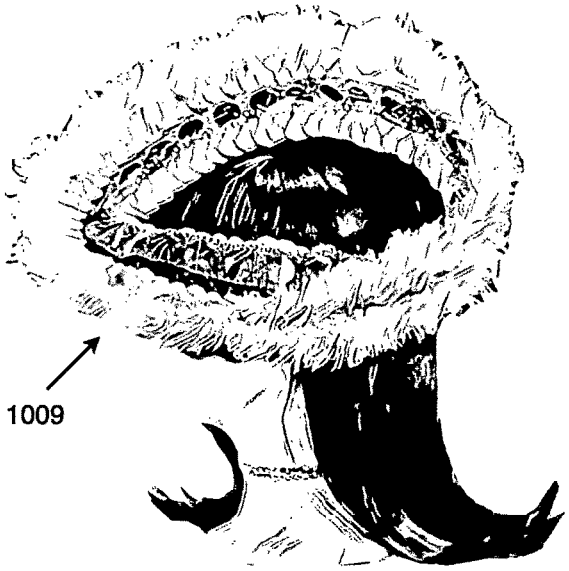
Figure 10J:
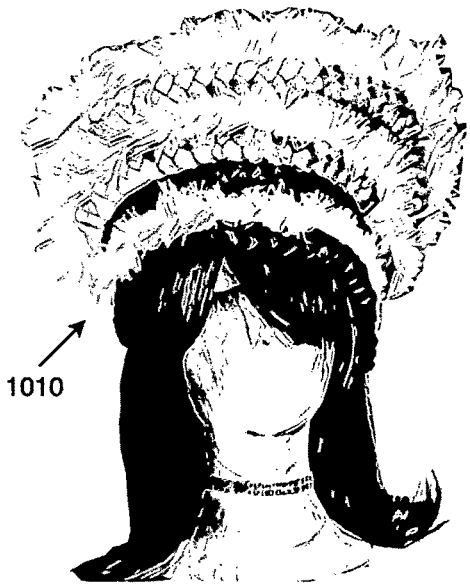
Figure 10K:
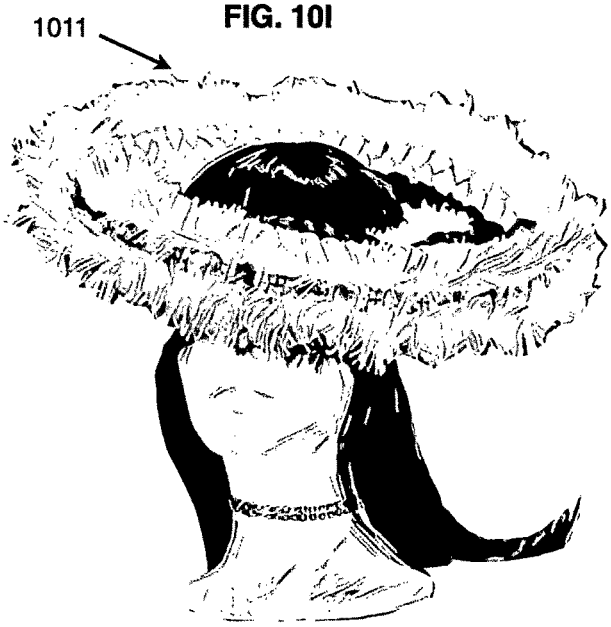
Figure 10L:
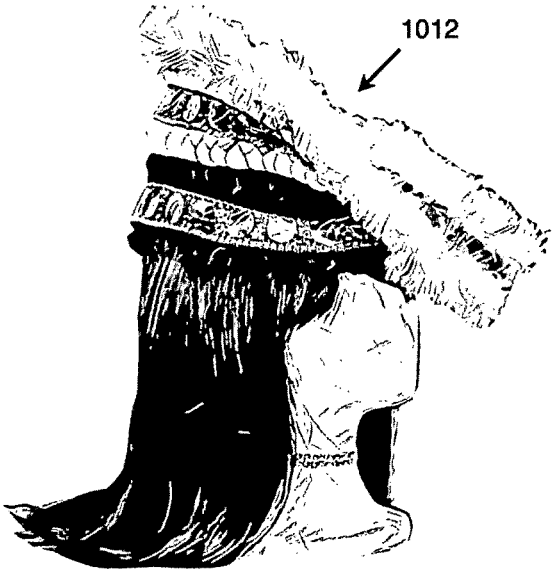
Figure 10M:
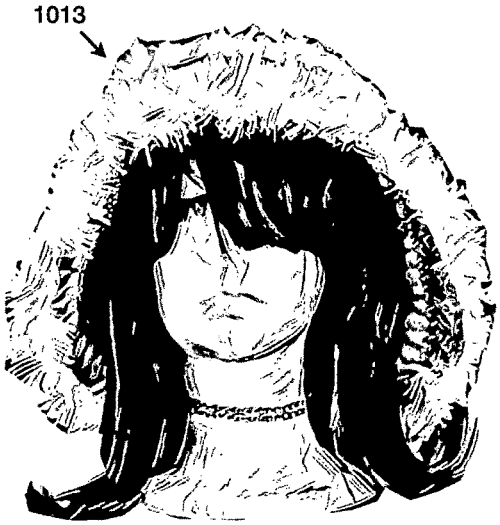
Figure 10N:
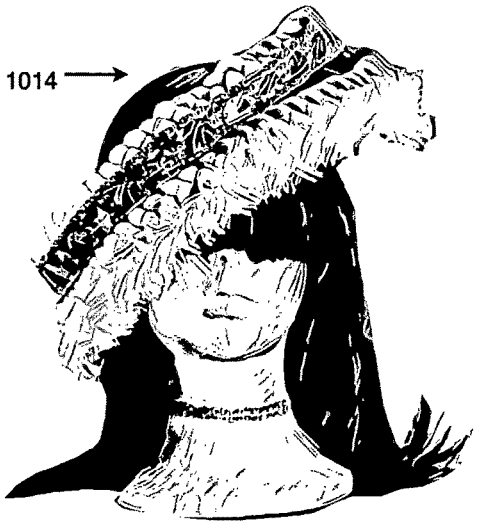
Figure 10O:
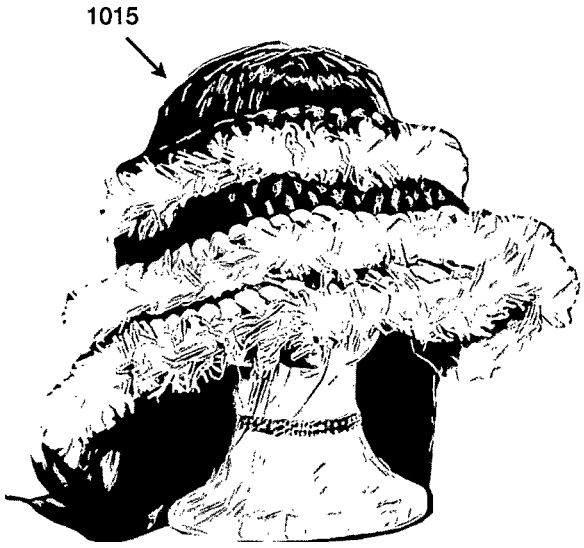
Figure 10P:
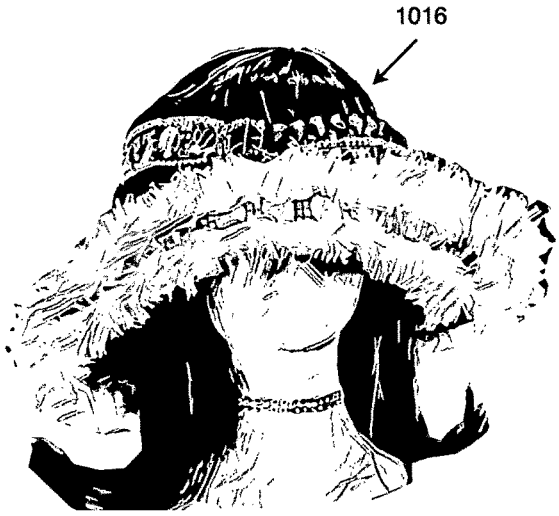
Figure 10Q:
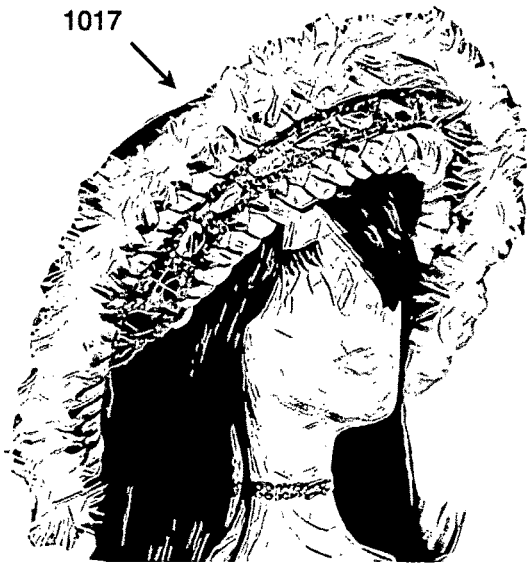
Figure 10R:
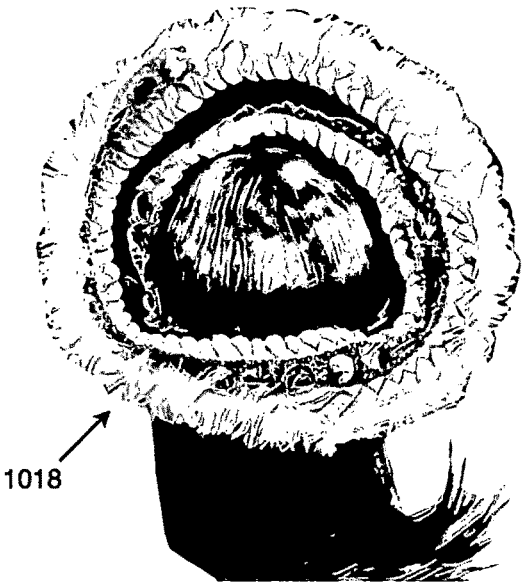
Figure 10S:
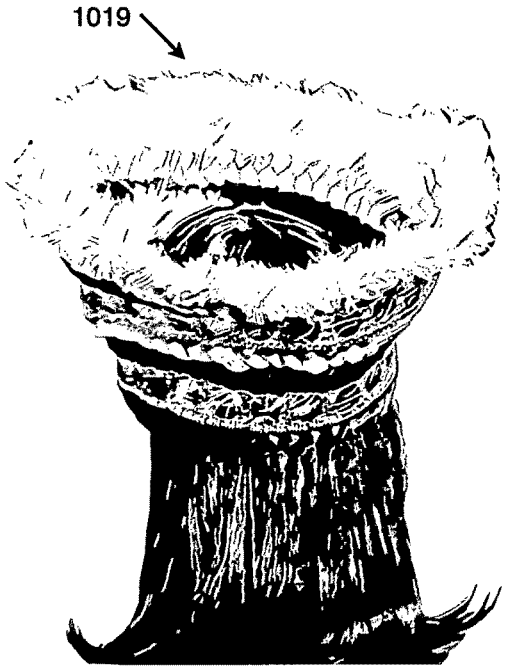
Figure 10T:
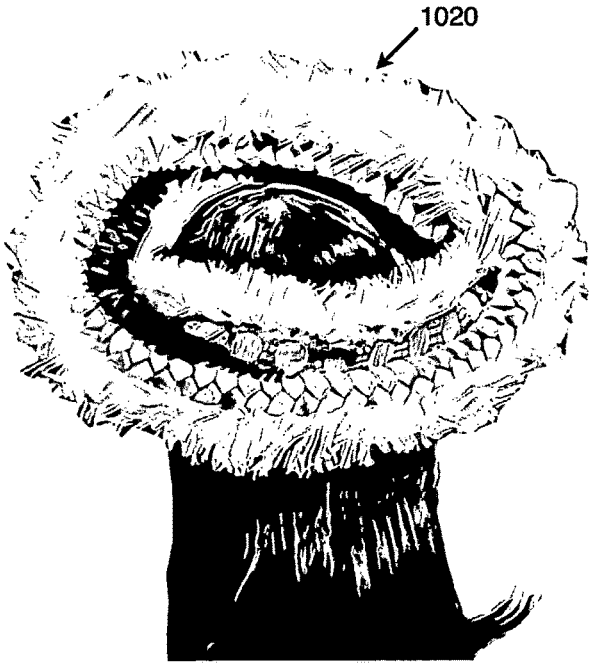

FIGS. 10A-10T are elevations of a custom made hat; braided with fur yarn, synthetic hair fibers and trim in showcasing various styles based on basketball theme. The flip action method is integrated in each hat/head garment to create the movement to change the desired look. In the figures as followed will demonstrate how these styles relate to the structures of the openings of each ends 102, 103, 107 and 108. 1001 relates to 102 and 103 with the smaller opening sitting on the crown of the head and larger opening sitting upright; the Crown Style. 1002 relates to 214 the Queen Style with a slight bend which changes the desired style. 1003 and 1004 relates to 905. 1005 and 1006 are Crown Styled with flipped sides related FIG. 1C. 1007 and 1008 are the CowGirl Style on reversed sides; flipped inside out. 1009 displays a flared out brim stylish look with the hair exposed relates to 102. 1010 relates to FIG. 1D. and 1011 with a change in movement creates a stylish look. 1012 is a side view which relates to FIG. 1D with one side flipped downward. 1013 relates to the Bonnet Style 216. 1014 flipped into a stylish look with the crown of head exposed. 1015 and 1016 relates to the Fisherman Style 702. 1017 is a side view in a flipped up styled by movement of the braided materials. 1018, 1019 and 1020 is a back views showcasing the wide opening upright and smaller opening sitting on crown of head; displaying various styles.

Figure 11:
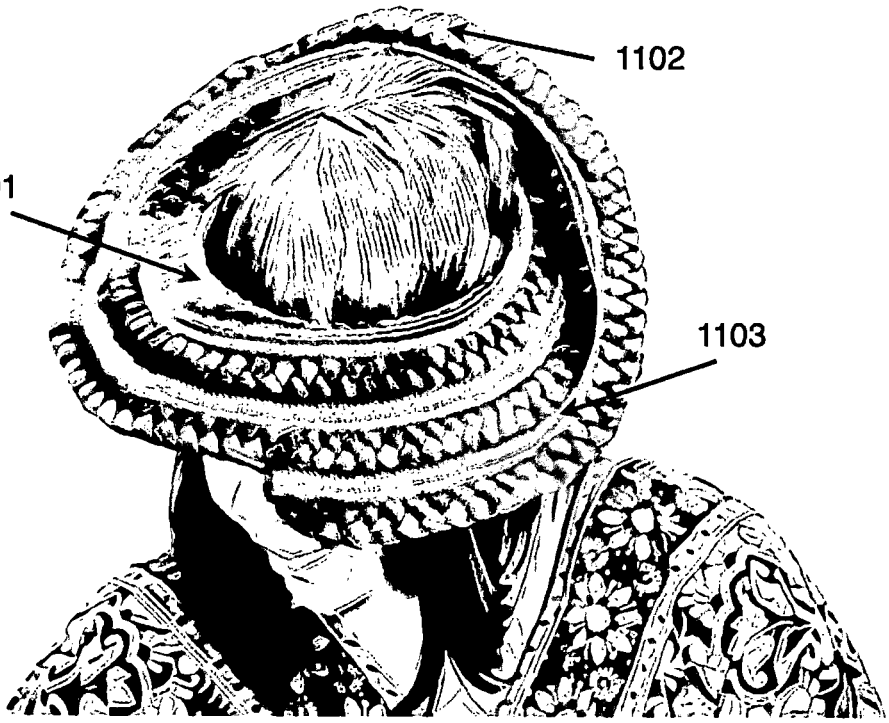

FIG. 11 is an elevation of a custom made hat/head garment; braided with synthetic hair fibers and embellished with a bling trim one hat flared. Alternating with synthetic hair fibers and embellished trim; at base and the larger opening in a changed position displaying a desired look. 1101 top view elevation of the open top circular braid pattern; 1102 braided with synthetic hair fibers alternated with 1103 embellished bling trim style. The smaller opening displayed at the base which sits on the crown of head. 1101 top view elevation of the open top circular braid pattern; 1102 braided with synthetic hair fibers alternating with 1103 embellished trim creates this stylish design.

Figure 12:
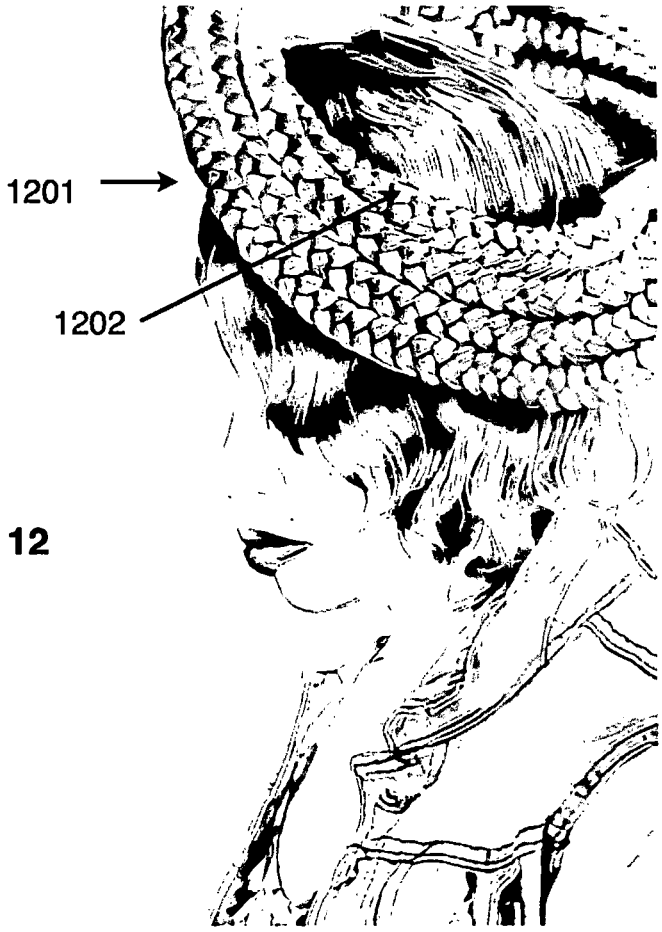

FIG. 12 is an elevation of a custom made hat/head garment braided with synthetic hair fibers in a circular direction with the top of head exposed. 1202 top view elevation of the open top circular braid pattern; 1201 braided with synthetic hair fibers. The crown of head/hair exposed 1202 with a continuous 1201 braided style altered by changing positions of braided materials.

Figure 13:
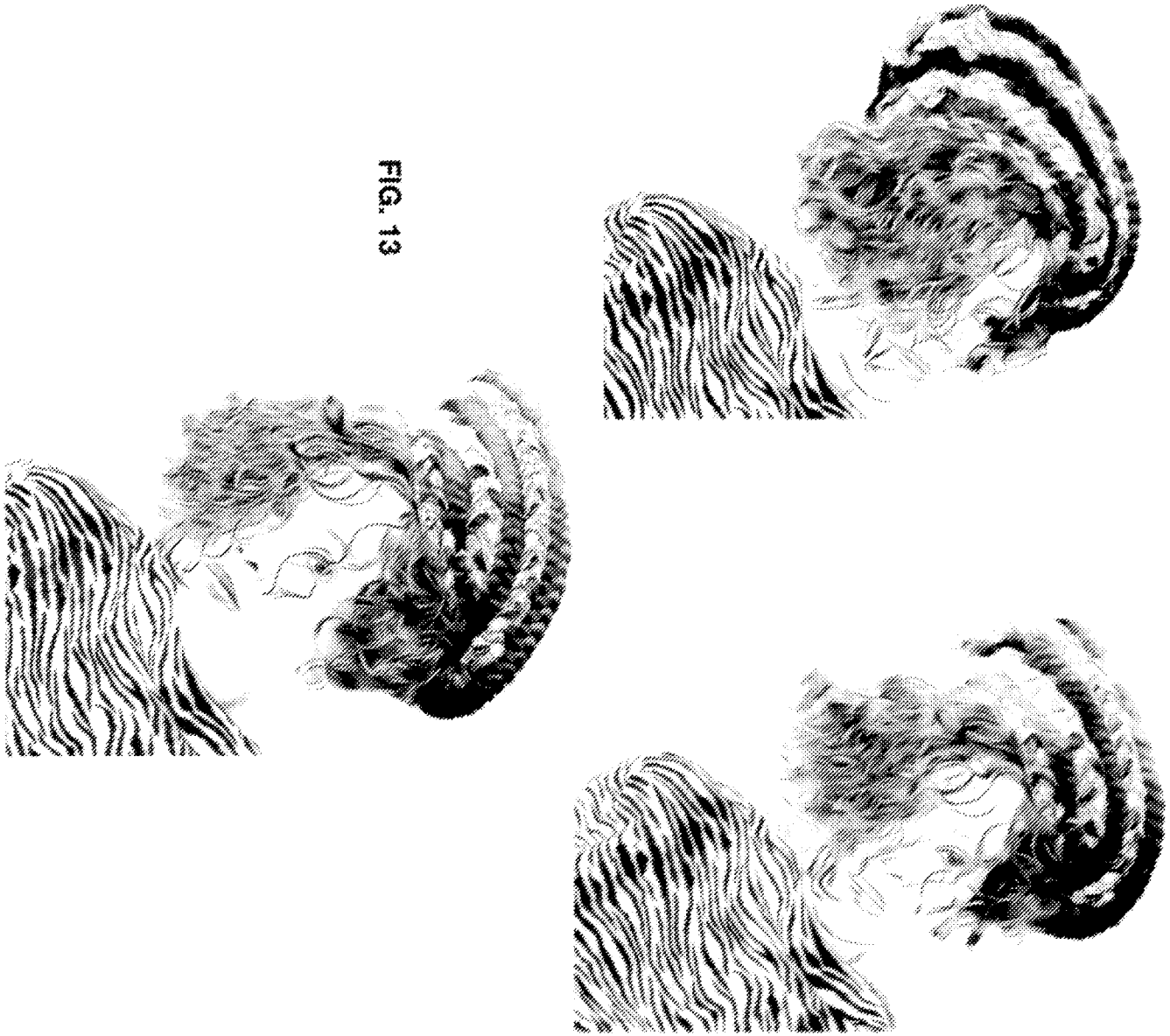

FIG. 13 elevation views of the Crown Styled Hat; braided with synthetic hair fibers and recycled jeans showing versatility in designer styles in fashion. Model M. Hughes.

What is claimed is:

1. A hat/head garment configured to be flipped from a first position to a second position, the garment consisting of:

a braided material stitched in a circular pattern in a abutting layers to shape said garment, a portion of said braided material forming a base, respective ones of said abutting layers being stitched together at spaced intervals along respective lengths of said respective abutting layers so as to permit relative movement of one said abutting layer with respect to an adjacent one of said abutting layers;

said abutting layers forming said garment being configured in a substantially frustoconical shape having a first open end and a second open end opposite said first open end, an exterior surface and an interior surface, said first open end and said second open end defining a first plane and a second plane, respectively, said open end being defined by said base;

said abutting layers forming said substantially frustoconical shape being oriented at a 45 degree angle with respect to said first plane, said angle permitting respective ones of said abutting layers to roll along respective abutting portions of said abutting layers;

whereby, in said first position a first portion of each of said abutting layers forms said exterior surface and a second portion of each of said abutting layers forms said interior surface, and rolling of said abutting layers permits reorientation of said abutting layers such that in said second position, at least a portion of said first portion forms said interior surface and at least a portion of said second portion forms said exterior surface.

* * * * *